US009117572B2

(12) United States Patent
Fukasaku

(10) Patent No.: US 9,117,572 B2
(45) Date of Patent: Aug. 25, 2015

(54) FOAMED COAXIAL CABLE AND MULTICORE CABLE

(71) Applicant: Hitachi Metals, Ltd., Tokyo (JP)

(72) Inventor: Izumi Fukasaku, Hitachi (JP)

(73) Assignee: Hitachi Metals, LTD., Tokyo (JP)

( * ) Notice: Subject to any disclaimer, the term of this patent is extended or adjusted under 35 U.S.C. 154(b) by 165 days.

(21) Appl. No.: 14/026,970

(22) Filed: Sep. 13, 2013

(65) Prior Publication Data

US 2014/0076608 A1 Mar. 20, 2014

(30) Foreign Application Priority Data

Sep. 14, 2012 (JP) ..... 2012-202631

(51) Int. Cl.
*H01B 11/18* (2006.01)
*H01B 11/20* (2006.01)
*H01B 7/02* (2006.01)

(52) U.S. Cl.
CPC ..... *H01B 11/18* (2013.01); *H01B 11/1839* (2013.01); *H01B 7/0216* (2013.01); *H01B 11/20* (2013.01)

(58) Field of Classification Search
CPC ..... H01B 11/18
USPC ..... 174/103, 102 R, 111, 112, 113 AS
See application file for complete search history.

(56) References Cited

U.S. PATENT DOCUMENTS

| | | | | |
|---|---|---|---|---|
| 3,040,278 | A * | 6/1962 | Griemsmann | 333/240 |
| 3,055,967 | A * | 9/1962 | Bondon | 174/28 |
| 4,866,212 | A * | 9/1989 | Ingram | 174/28 |
| 5,210,377 | A * | 5/1993 | Kennedy et al. | 174/107 |
| 6,239,377 | B1 * | 5/2001 | Nishikawa | 174/110 R |
| 7,897,874 | B2 * | 3/2011 | Park et al. | 174/110 R |
| 8,455,761 | B2 | 6/2013 | Hayashishita et al. | |
| 2003/0070831 | A1 * | 4/2003 | Hudson | 174/113 R |
| 2006/0213681 | A1 * | 9/2006 | Magner | 174/120 R |
| 2010/0288529 | A1 | 11/2010 | Hayashishita et al. | |

FOREIGN PATENT DOCUMENTS

| | | | |
|---|---|---|---|
| JP | 2003-141944 | A | 5/2003 |
| JP | 2008-293862 | A | 12/2008 |
| JP | 2010-80097 | A | 4/2010 |

* cited by examiner

*Primary Examiner* — Timothy Thompson
*Assistant Examiner* — Michael F McAllister
(74) *Attorney, Agent, or Firm* — McGinn IP Law Group, PLLC

(57) ABSTRACT

A foamed axial cable includes a pair of signal conductors, an insulation covering a periphery of the signal conductor and formed of a foamed material, a skin layer covering a periphery of the insulation and formed of a non-foamed material, and a shield conductor on a periphery of the skin layer. An outer surface of the skin layer or an inner surface of the shield conductor includes a fine groove formed thereon so as to have a void between the skin layer and the shield conductor.

5 Claims, 3 Drawing Sheets

FOAMED COAXIAL CABLE AND MULTICORE CABLE

The present application is based on Japanese patent application No. 2012-202631 filed on Sep. 14, 2012, the entire contents of which are incorporated herein by reference.

BACKGROUND OF THE INVENTION

1. Field of the Invention

This invention relates to a foamed coaxial cable and a multicore cable using an insulation formed of a foamed material.

2. Description of the Related Art

A high speed transmission foamed coaxial cable is known that uses a low-permittivity insulation formed of a foamed material (See e.g. JP-A-2003-141944).

For example, a foamed coaxial cable 21 as shown in FIG. 2 is known that is composed of a pair of signal conductors 2, an insulation (or formed insulation) 3 which is of a foamed material for collectively covering the periphery of the signal conductor 2, a non-foamed skin layer (or outer skin layer) 4 which covers the periphery of the insulation 3, and a shield conductor 5 disposed on the periphery of the skin layer 4.

The other related art may be JP-A-2010-080097 and JP-A-2008-293862.

SUMMARY OF THE INVENTION

The foamed coaxial cable 21 operates in two transmission modes, i.e., a differential mode to transmit differential signals through the pair of signal conductors 2, and a common mode to transmit common phase signals through the pair of signal conductors 2.

In the differential-mode signal transmission, an electric field concentrates on the region between the signal conductors 2 and therefore the propagation speed in the differential mode mainly depends on the relative permittivity of the insulation 3 (i.e. the foamed material) existing between the signal conductors 2.

On the other hand, in the common-mode signal transmission, an electric field concentrates on between the signal conductor 2 and the shield conductor 5 and therefore the propagation speed in the common mode depends on the relative permittivity of both of the insulation 3 and the skin layer 4 existing between the signal conductors 2 and the shield conductor 5. The propagation speed V of signal at a relative permittivity $\epsilon_r$ is represented by:

$$V=V_c/(\epsilon_r)^{1/2}$$

where $V_c$ is the speed of light.

The skin layer 4 has a high permittivity since it is not foamed. Therefore, the foamed coaxial cable 21 operates such that the propagation speed in the common mode is lower than that in the differential mode so as to differ in the propagation speed between the differential mode and the common mode. Thus, the foamed coaxial cable 21 may cause a skew between the differential mode and the common mode.

Since the differential signal is mainly used in the high-speed transmission, the skew between the differential mode and the common mode may not affect the transmission characteristics on ideal conditions. However, when the symmetry of the cable structure is destroyed due to manufacturing variations etc., a mutual coupling (i.e. a coupling between differential and common modes (SCD21, SDC21)) such as the differential more to the common mode or the common mode to the differential mode may occur. In such a case, the transmission characteristics (the skew characteristics of differential signal) may deteriorate sue to the skew between the differential mode and common mode.

Since it is impossible to completely eliminate the coupling between the differential and common modes, it is desired to have a foamed coaxial cable to prevent the deterioration of transmission characteristics even when the coupling between the differential and common modes occurs.

Meanwhile, although a method may be devised that prevents the skew between the differential and common modes by removing the skin layer 4, other problems may occur when the skin layer 4 is removed. This is because the skin layer 4 serves to protect the insulation 3 of the foamed material with a low mechanical strength and to prevent the water from penetrating.

It is an object of the invention to a foamed coaxial cable and a multicore cable that prevent the deterioration of transmission characteristics even when the coupling between the differential and common modes occurs.

(1) According to one embodiment of the invention, a foamed coaxial cable comprises:

a pair of signal conductors;

an insulation covering a periphery of the signal conductor and formed of a foamed material;

a skin layer covering a periphery of the insulation and formed of a non-foamed material; and a shield conductor on a periphery of the skin layer, wherein an outer surface of the skin layer or an inner surface of the shield conductor comprises a fine groove formed thereon so as to have a void between the skin layer and the shield conductor.

In the above embodiment (1) of the invention, the following modifications and changes can be made.

(i) The groove comprises a groove formed on the outer surface of the skin layer.

(ii) The groove is formed on the outer surface of the skin layer so as to be at equal intervals in a circumferential direction of the skin layer and to be along a longitudinal direction of the cable.

(iii) A volume ratio x of a volume of the void to a volume of the skin layer before the void is formed meets a formula:

$$x=(\epsilon r_1-\epsilon r_2)/(1-\epsilon r_2)$$

where $\epsilon r_1$ is a relative permittivity of the insulation, and $\epsilon r_2$ is a relative permittivity of the skin layer.

(2) According to another embodiment of the invention, a multicore cable comprises:

a plurality of cables twisted; and a protection jacket formed on a periphery of the plurality of cables, wherein one of the plurality of cables comprises the foamed coaxial cable according to the embodiment (1).

Effects of the Invention

According to one embodiment of the invention, a foamed coaxial cable and a multicore cable can be provided that prevent the deterioration of transmission characteristics even when the coupling between the differential and common modes occurs.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

The foamed coaxial cable of the embodiment will be described below with reference to the attached drawing.

Figure 1:
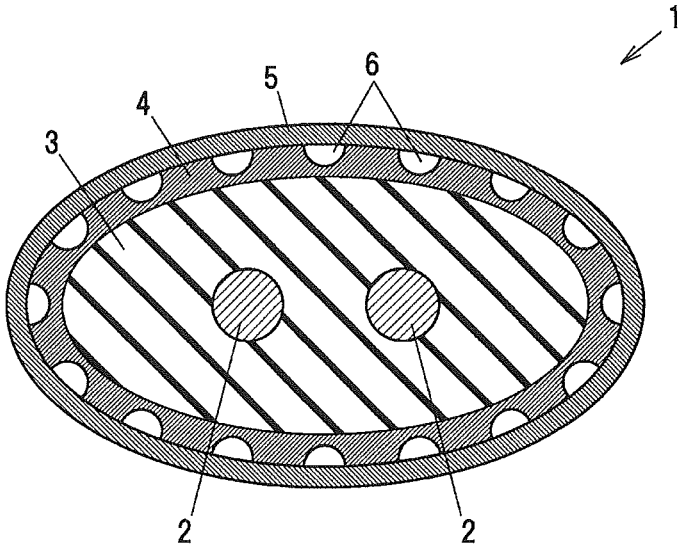
FIG. 1 is a cross sectional view showing a foamed coaxial cable in a preferred embodiment according to the invention.
Figure 2:
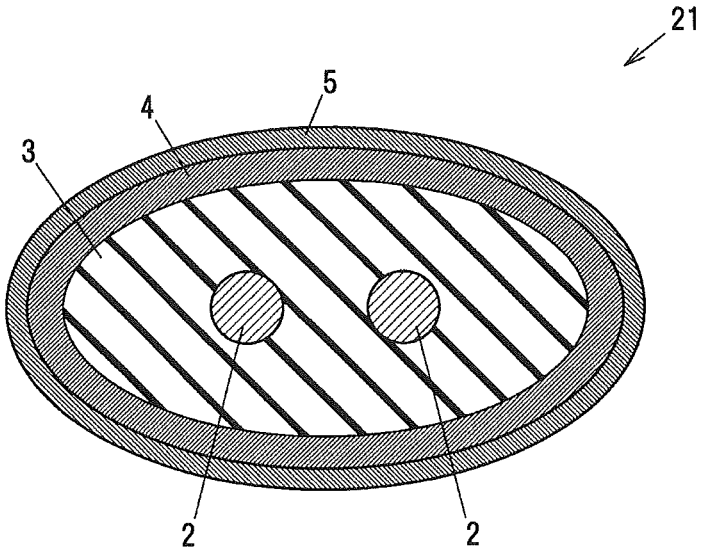
FIG. 2 is a cross sectional view showing a conventional foamed coaxial cable.

FIG. 1 is a cross sectional view showing the foamed coaxial cable in the embodiment according to the invention.

As shown in FIG. 1, a foamed coaxial cable 1 is composed of a pair of signal conductors 2, an insulation 3 which is of a foamed material for collectively covering the periphery of the signal conductor 2, a non-foamed skin layer 4 which covers the periphery of the insulation 3, and a shield conductor 5 disposed on the periphery of the skin layer 4.

The pair of signal conductors 2 are disposed in parallel, and the insulation 3, which is elliptical in sectional view, is formed collectively covering the pair of conductors 2. The skin layer 4 serves to protect the insulation 3 of the foamed material with a low mechanical strength and to prevent the water from penetrating. Although not shown in FIG. 1, an insulation layer may be formed on the periphery of the shield layer 5 by winding an insulating tape or covering a sheath.

The foamed coaxial cable 1 of the embodiment has a void 6 that is provided by forming a fine groove on the outer surface of the skin layer 4 or on the inner surface of the shield conductor 5. The void 6 functions to reduce the effective permittivity in the common mode and is formed by controlling such that it is uniformly distributed between the skin layer 4 and the shield layer 5.

In the embodiment, the groove (i.e. void 6) is formed by cutting away a part of the outer surface of the skin layer 4. The invention is not limited to this method, and the fine groove may be formed by roughening the outer surface of the skin layer 4. The depth of the groove needs to be sufficiently small with respect to the wavelength of transmitted signals. It needs to be at least smaller than the depth (e.g. about hundreds of micrometers) of the skin layer 4.

In the embodiment, the groove (i.e. void 6) is formed on the outer surface of the skin layer 4 to be at equal intervals in the circumferential direction and is formed along the longitudinal direction of the cable. Although in the embodiment the groove (i.e. void 6) is formed in this shape so as to facilitate the manufacture (or to enhance the mass productivity), it is not limited to that shape. For example, the groove may be formed spiral or in a random shape. When the groove (i.e. void 6) is formed periodically, a resonance may occur so as to affect the transmission characteristics. Thus, the groove (i.e. void 6) is preferably formed in a random shape (not periodically) so as to enhance the transmission characteristics.

The voids 6 are formed such that the volume ratio x of the total volume of the voids 6 to the volume of the skin layer 4 before the voids 6 are formed is to meet the formula:

$$x=(\epsilon_{r_1}-\epsilon_{r_2})/(1-\epsilon_{r_2})$$

where $\epsilon_{r_1}$ is the relative permittivity of the insulation 3, and $\epsilon_{r_2}$ is the relative permittivity of the skin layer 4.

Thereby, the effective relative permittivity is equal between the differential and common modes such that the skew between the differential and common modes can be prevented. Even when the volume ratio x of the void 6 to the skin layer 4 does not meet the above formula, the difference in effective relative permittivity between the differential and common modes can be reduced so as to reduce the skew between the differential and common modes by controlling the void 6 to be close as much as possible to the volume ratio x to meet the above formula.

For example, if the relative permittivity $\epsilon_{r1}$ of the insulation 3 is 1.8 and the relative permittivity $\epsilon_{r2}$ of the skin layer 4 is 2.2, x=⅓ is calculated. Thus, the voids 6 only have to be formed such that the volume of the skin layer 4 after the voids 6 are formed and the total volume of the voids 6 meet (the volume of the skin layer 4):(the volume of the void 6)=2:1.

Figure 3:
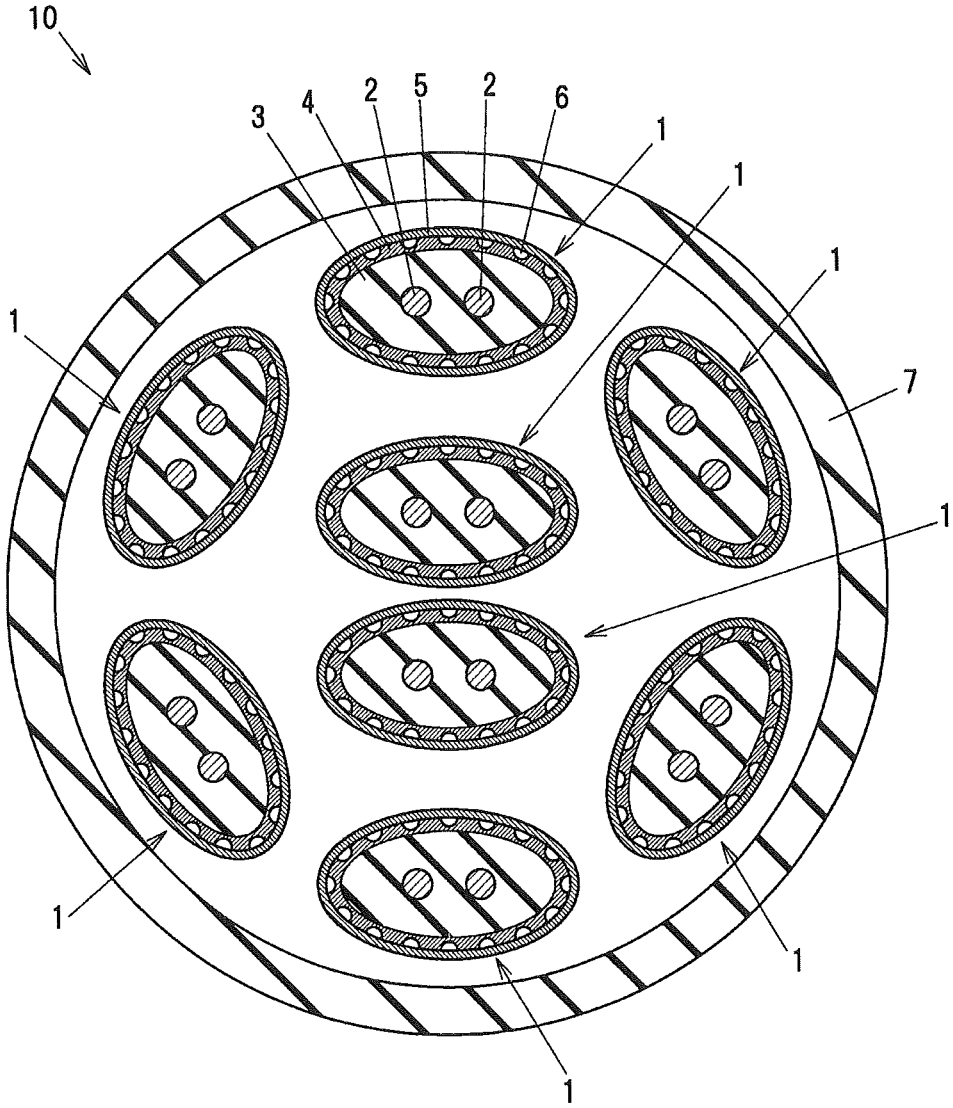
FIG. 3 is a cross sectional view showing a multicore cable in an embodiment according to the invention.

As shown in FIG. 3, a multicore cable Id of the invention can be obtained by twisting the plural foamed coaxial cables 1 and fowling a protection jacket 7 on the periphery thereof. All of the cables included in the multicore cable 10 do not need to use the foamed coaxial cable 1 of the invention, and the multicore cable including at least one cable using the foamed coaxial cable 1 of the invention is included in the invention.

As described above, the foamed coaxial cable 1 of the embodiment is provided with the void 6 that is made by forming the fine groove on the outer surface of the skin layer 4 or on the inner surface of the shield conductor 5.

Providing the void 6 enables to reduce the effective permittivity in the common mode, i.e., to cancel the high permittivity of the skin layer 4 by the low permittivity of the void 6 such that the effective permittivity of the differential mode is equal (or close) to that of the common mode. As a result, the propagation speed between the differential mode and the common mode can be equal (or close) to each other so as to prevent the skew between the differential and common modes. Thereby, the deterioration of transmission characteristics can be prevented even when the coupling between the differential and common modes occurs due to manufacturing variations etc.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

Although in the above embodiment the void 6 is exemplified by forming the fine grooves on the outer surface of the skin layer 4, the void 6 may be made by forming fine grooves on the inner surface of the shield conductor 5 by embossing the inner surface of the shield conductor 5.

Also, an interposition with a groove corresponding to the void 6 may be sandwiched between the skin layer 4 and the shield conductor 5. In this case, since the interposition can be handled as a part of the skin layer 4, it is the same as the embodiment where the void 6 is formed on the outer surface of the skin layer 4.

What is claimed is:

1. A foamed axial cable, comprising:

a pair of signal conductors;

an insulation covering a periphery of the signal conductor and formed of a foamed material;

a skin layer covering a periphery of the insulation and formed of a non-foamed material; and a shield conductor on a periphery of the skin layer, wherein an outer surface of the skin layer or an inner surface of the shield conductor comprises a fine groove formed thereon so as to have a void between the skin layer and the shield conductor.

2. The foamed axial cable according to claim 1, wherein the groove comprises a groove formed on the outer surface of the skin layer.

3. The foamed axial cable according to claim 1, wherein the groove is formed on the outer surface of the skin layer so as to be at equal intervals in a circumferential direction of the skin layer and to be along a longitudinal direction of the cable.

4. The foamed axial cable according to claim 1, wherein a volume ratio x of a volume of the void to a volume of the skin layer before the void is formed meets a formula:

$$x=(\epsilon_{r_1}-\epsilon_{r_2})/(1-\epsilon_{r_2})$$

where $\epsilon_{r_1}$ is a relative permittivity of the insulation, and $\epsilon_{r_2}$ is a relative permittivity of the skin layer.

5. A multicore cable, comprising:

a plurality of cables twisted; and a protection jacket formed on a periphery of the plurality of cables, wherein one of the plurality of cables comprises the foamed coaxial cable according to claim 1.

* * * * *